US005123773A

United States Patent [19]

Yodock

[11] Patent Number: 5,123,773

[45] Date of Patent: Jun. 23, 1992

[54] STAND-ALONE HIGHWAY BARRIER

[75] Inventor: Leo J. Yodock, Bloomsburg, Pa.

[73] Assignee: Rose Enterprises Inc., Bloomsburg, Pa.

[21] Appl. No.: 599,652

[22] Filed: Oct. 18, 1990

[51] Int. Cl.[5] ..... E01F 13/00

[52] U.S. Cl. ..... 404/6; 256/13.1

[58] Field of Search ..... 404/6, 7, 8, 9; 256/13.1

[56] References Cited

U.S. PATENT DOCUMENTS

| | | | |
|---|---|---|---|
| 4,665,673 | 5/1987 | Diana | 404/6 X |
| 4,773,629 | 9/1988 | Yodock | 256/13.1 |
| 4,869,617 | 9/1989 | Chiodo | 404/6 |
| 4,946,306 | 8/1990 | Yodock | 256/13.1 X |
| 4,978,245 | 12/1990 | White | 404/6 |

*Primary Examiner*—George A. Suchfield

*Attorney, Agent, or Firm*—Lerner, David, Littenberg, Krumholz & Mentlik

[57] ABSTRACT

Highway barriers are disclosed for either single or combined use, including a hollow container made of a semi-rigid plastic. The side walls of the container include vertical indentations in order to maintain the structural integrity of the container and to create inner baffles for dampening movement of a fluid within the container upon filing thereof. Preferably, the end walls of the container include interlocking male and female portions so that the barriers can be attached end-to-end at various angles.

50 Claims, 6 Drawing Sheets

STAND-ALONE HIGHWAY BARRIER

The present invention relates to highway barriers. More particularly, the present invention relates to stand-alone highway barriers. Still more particularly, the present invention relates to such barriers which can be used either singly or in combination for various highway usages. Still more particularly, the present invention relates to stand-alone highway barriers which can replace previous cones, stanchions, and the like.

BACKGROUND OF THE INVENTION

A variety of different devices are known in the art for absorbing the kinetic energy of impact of colliding automobiles and other vehicles. These include, on the one hand, devices which are primary intended to provide a continuous highway barrier along the center line of a highway when laid in an end-to-end relationship primarily for the purpose of absorbing grazing blows from moving automobiles and the like. On the other hand, these devices also include devices which are intended to be used singly or in combination as markers, delineators, and the like, for various uses along the highway to both mark locations and present the energy-absorbing buffers discussed above. These latter devices, which can be referred to as attenuators, include, for example, that shown in U.S. Pat. No. 3,703,600 to Rich. This patent thus discloses a resiliently deformable body have a chamber which can be filled with liquid, and which includes separate passageways by which the liquid can be forced from the body upon impact. The preferred embodiments in this invention are cylindrical upstanding buffer members such as those shown in FIGS. 2 and 3 thereof.

Another such structure is shown in U.S. Pat. No. 3,540,699 to Guzzardella. In this patent a tubular or bag-type container is at least partially filled with water, again for the absorption of kinetic energy upon automobile impact. Devices in the Guzzardella patent can be used singly or in combination, and are not produced from semi-rigid material; that is, they cannot retain their configuration by themselves when filled with liquid, but require separate means to do so.

Yet another such barrier is disclosed in be frangible, and is said to be freely displaceable upon impact. These barriers, which can be filled with sand, have a center of gravity which is disposed above its vertical midpoint so as to decelerate a vehicle upon impact.

Apart from these devices, a number of devices have been developed which are specifically intended to be laid end-to-end to create a continuous wall or highway barrier. These include, for example, the energy-absorbing barriers shown in U.S. Pat. No. 4,681,302 to Thompson. In this case yet another barrier intended to be filled with water is shown, in this case including fittings for coupling one barrier to another at the ends thereof in a continuous string to define a traffic lane. The walls of the Thompson device are thus said to be resiliently deformable by resuming their normal shape after being struck and include longitudinally extending spaced-apart traction spoiler channels which are said to reduce the area of potential impact and thus the tendency of tires to climb the walls and vault a vehicle over the barrier. Means for coupling the barriers are shown in FIGS. 1 and 4 of this patent and include vertically aligned knuckles or protuberances 36 and intervening recesses 38 adapted to interlock in the manner shown and then receive a connecting pin 42 to hold them together.

A concrete barricade is shown in U.S. Pat. No. 4,059,362 to Smith which includes a recess 11 and protection 12 integrally molded on the ends of the barricades comprising a tongue-and-groove coupling for interconnecting same.

Finally, a most recent development and improvement in such highway barriers is set forth in U.S. Pat. Nos. 4,773,629 and 4,946,306 to Yodock. These patents disclose such highway barriers which comprise a longitudinally extending container made of semi-rigid plastic material which is self-supporting, having a predetermined shape, and which when filled with water or other liquid maintains that shape and substantially increases in weight. These devices are laid end-to-end and connected by means of a separate key, which can be seen in FIGS. 3, 5, and 6 thereof, and which is inserted in the grooves 50 of adjacent barriers to secure them to each other. These barriers also include means for filling consecutive barriers through interconnecting openings in the ends of the respective barriers.

While these devices have proved highly effective in many circumstances, the search has continued, however, for improved highway barriers which are able to stand and be used individually and which are also easy to interconnect, fill with liquid, and employ on a commercial basis.

SUMMARY OF THE INVENTION

In accordance with the present invention, these and other objects have now been realized by the discovery of a highway barrier including a longitudinally extending container having a base portion, a pair of side walls, a pair of end walls, and a tope portion, in which the container is substantially hollow and comprises a semi-rigid plastic material such that the containing is self-supporting and has a predetermined shape, with a pair of side walls including a plurality of vertically extending indentations which include an inwardly directed base portion and a pair of side walls, such that the structural integrity of the container is maintained, and the pair of side walls creates baffles within the container so that upon filling the container with a fluid the structural integrity of the container continues to be maintained and movement of the fluid within the container is dampened.

In accordance with a preferred embodiment of the highway barrier of the present invention, the vertically extending indentations include an inner wall surface. In a preferred embodiment the base portion of the vertically extending indentations has a trapezoidal shape, the side walls of the vertically extending indentations have triangular shapes, and the inner wall surface of the vertically extending indentations has a rectangular surface.

In accordance with another embodiment of the highway barrier of the present invention, the pair of end walls includes a first end wall having a protruding male portion and a second end wall having an inwardly directed female portion such that a plurality of these highway barriers can be attached in an end-to-end relationship to provide a continuous highway barrier structure. In a preferred embodiment the male portion of the first end wall and the female portion of the second end wall extend vertically from the base portion of the container to the top portion of the container. Preferably the protruding male portion of the first end wall and the inwardly directed female portion of the second end wall are substantially cylindrical in configuration.

In accordance with another embodiment of the highway barrier of the present invention, filling means are provided for filling the substantially hollow container with a fluid whereby filling of the container substantially increases the weight of the container without changing its predetermined shape.

In accordance with another embodiment of the highway barrier of the present invention, the pair of side walls includes a lower portion extending substantially vertically from the base portion for a first predetermined distance, an intermediate portion projecting inwardly from the lower portion a second predetermined distance at a predetermined angle with respect to the vertical, and an upper portion extending substantially vertically from the intermediate portion a third predetermined distance to the top portion of the longitudinally extending container. In a preferred embodiment the vertically extending indentations are substantially contained within the intermediate portion of the side walls.

In accordance with another embodiment of the highway barrier of the present invention, the highway barrier comprises a longitudinally extending container having a base portion, a pair of side walls, and a pair of end walls, and a top portion, said container being substantially hollow and comprising a semi-rigid plastic material whereby the container is self-supporting and has a predetermined shape, a pair of end walls and a second end wall, the first end wall including a substantially cylindrical protruding male portion and a second end wall including a correspondingly substantially inwardly directed female portion adapted to accept said male portion, whereby a plurality of the highway barriers can be attached in an end-to-end relationship and the longitudinal alignment of the plurality of highway barriers can be altered to a predetermined longitudinal alignment by rotating the male portion within the female portion.

In a preferred embodiment, the highway barrier includes connecting means for fixedly connecting the plurality of highway barriers together in that predetermined longitudinal alignment. Preferably the connecting means includes bolt means extending transversely through the male and female portions of the attached plurality of highway barriers and nut means for affixing the bolt means therein.

In a highly preferred embodiment the bolt means comprises a pair of bolt members which are perfectly disposed parallel to each other.

BRIEF DESCRIPTION OF THE DRAWINGS

The nature of the present invention and other aspects thereof may be appreciated by reference to the following detailed description, which in turn refers to the drawings, in which.

DETAILED DESCRIPTION

Figure 1:
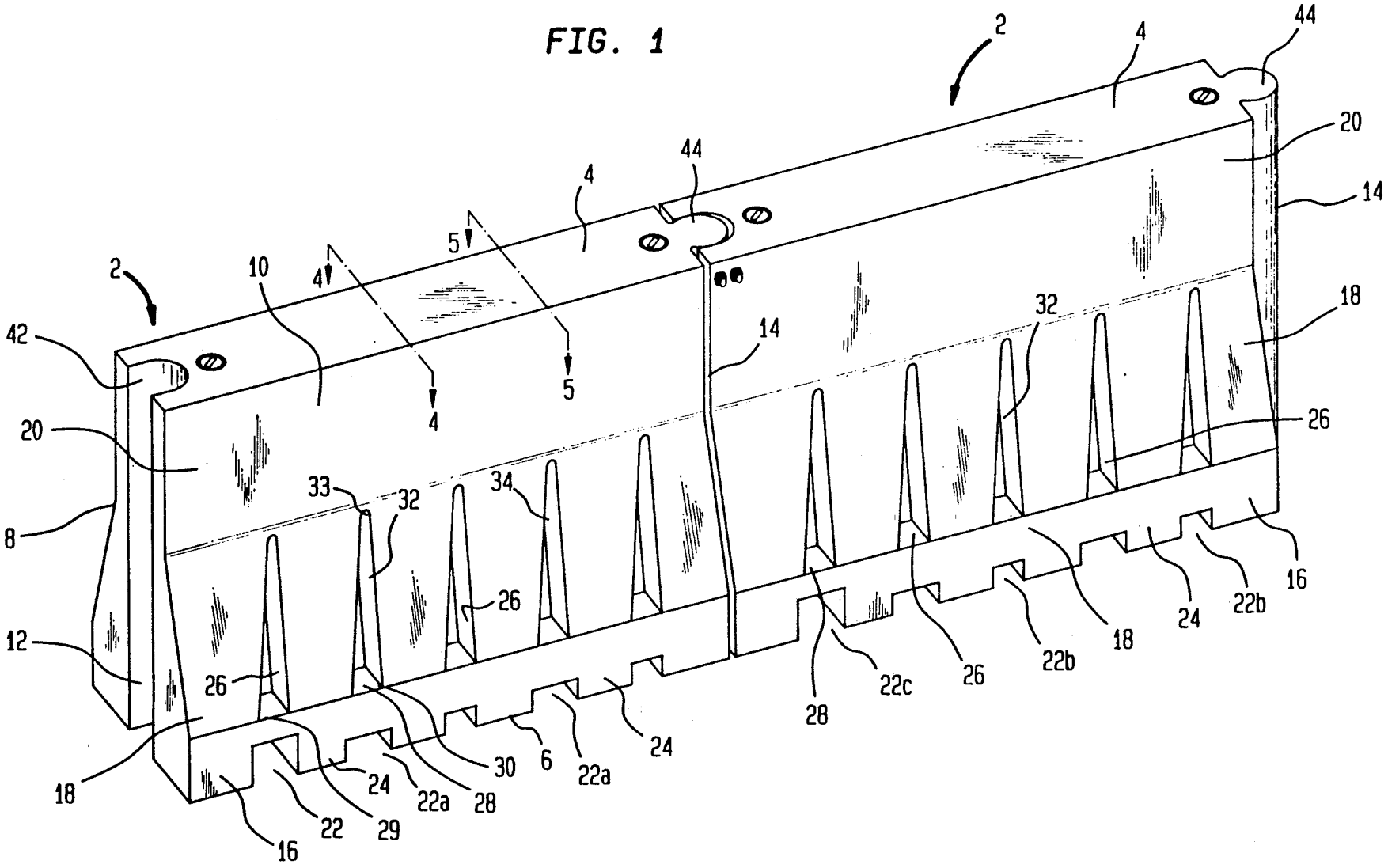
FIG 1 is a top elevational, perspective view of a pair of highway barriers in accordance with the present invention attached to each other.

Referring to the Figures, in which like numerals refer to like portions thereof, FIG. 1 shows a pair of stand alone highway barriers in accordance with the present invention connected to each other. Each such highway barrier 2 thus comprises a longitudinally extending structure. Each such structure includes a top wall 4, a bottom wall 6 upon which the structure stands, a pair of side walls 8 and 10, and a pair of end walls 12 and 14 as seen in the longitudinal direction thereof. The particular shape of the barrier 2 shown in FIG. 1, which in general configuration is in the form of a so-called "New Jersey barrier," is of considerable significance. Thus, it can be seen that each of these side walls 8 and 10 specifically includes a base portion 16 which includes substantially vertically disposed side wall sections, preferably about 7 inches high, an intermediate wall portion 18 which includes an angularly disposed side wall which extends inwardly toward each other as they rise upwardly from the base portion 16, and an upper portion 20 which again extends essentially vertically from the upper part of the intermediate portion 18 to the top wall 4, and is preferably about 17 inches high. The end walls 12 and 14 extend continuously from the bottom 6 to the top 4, although, as can be seen from FIGS. 2–5, the side projections thereof will follow the shape of the corresponding base portion 16, intermediate portion 18 and upper portion 20 thereof.

As can further be seen, the top wall 4 of the highway barrier 2 extends substantially horizontally, connecting the end walls 12 and 14, as well as the top portions 20 of the side walls 8 and 10 thereof. The base portions 16 of the side walls 8 and 10 include a number of openings or passageways 22 connected by intermediate leg portions 24, which passageways 22 extend across the base portion 16 of the barriers 22 to not only support the barrier itself but to permit water or other liquids to run under the barrier from one side to the other. A highly preferred embodiment of the present invention is shown in FIG. 1 in which a number of passageways 22 are provided corresponding to the number of indentations 26, which are discussed in more detail below. In the case shown in FIG. 1 the passageways 22 include passageways having different sizes. Thus the first pair of passageways 22*a* is provided having a width of from about 6 to 7 inches, and most preferably of about 6½ inches, and a height of about 2 inches, again extending all the way across the base portion 16 of the highway barrier 2. A second pair of passageways 22*b* is then provided having a shorter width of between about 3 and 4 inches, most preferably about 3½ inches, and a height of 2 inches, the same as that of passageways 22*a*. These two pairs of alternating passageways 22*a* and 22*b* can thus accommodate two different size forklifts for lifting and moving the highway barriers, as well as also performing the function of permitting water to run through the barrier as mentioned above. In addition, a third sized passageway 22*c* is also provided, having a width of about 6½ inches and a height of about 3 inches, and which is thus higher than the height of passageways 22*a* and 22*b*. Passageway 22*c* is provided solely for purposes of permitting larger amounts of water to pass therethrough.

The barriers 2 themselves are made of semi-rigid plastic material which can include materials such as low density polyethylene, acrylonitrile or butadiene styrene, high-impact styrene, polycarbonates and the like. These semi-rigid plastic materials are all inherently tough and are more energy absorbing than other existing materials. They will also deform and elongate, but will not fail in a brittle manner at energy inputs which cause other materials to undergo brittle failure. Furthermore, the surface of these types of materials is inherently smoother than other materials from which barriers can be made, and it is therefore less likely that people and/or vehicles contacting the barrier at an angle will suffer serious abrasion injuries or damage. Furthermore, these materials are unaffected by weather and have excellent basic resistance to weathering, leaching or biodegradation, and will also retain their mechanical and chemical properties at low ambient temperatures.

As can further be seen from the Figures, the highway barriers 2 are hollow in construction, and the interior portion of these barriers can remain hollow, or can be filled with water or other liquid. In addition, it is also possible to fill these barriers with sand or a similar flowable solid material. Barriers 2 produced from the semi-rigid materials discussed above generally will have a thickness of between about ⅛ inch to about 1 inch so as to perform satisfactorily in service. Thus, such a barrier which is about 6 to 8 feet long in accordance with this invention will weigh between about 80 to 140 pounds when it is empty, and between 1,400 to 2,200 pounds when filled with liquid such as water, and will, of course, be considerably heavier when filled with sand or the like. In general, however, the term "semi-rigid" is meant to imply that the barriers are made from material which is capable of allowing the barrier to hold its own shape under normal use but which will flex before breaking. This can be contrasted to a "rigid" barrier, which will also hold its own shape but which will not flex before breaking, or a "non-rigid" barrier which will not hold its own shape in the first instance.

Referring again to FIG. 1, the highway barriers of the present invention are intended for a variety of uses. Thus, these barriers can be used in accordance with the general form of use shown in prior U.S. Pat. Nos. 4,773,629 and 4,946,306; namely, aligned in an end-to-end continuous relationship attached at either end so as to provide a continuous highway barrier structure. On the other hand, however, these barriers are also intended for stand alone use with one or a small number of such barriers in a manner, for example, such as the deceleration barrier shown in U.S. Pat. No. 3,606,258. In that case, these barriers, instead of providing a continuous dividing line in a highway or the like, are intended to denote and protect specific highway related obstacles such as bridge abutments, traffic circles, and other solid or semi-rigid obstacles present along the highway. For these purposes, one or a number of these barriers can be used as attenuators, so as to provide the energy-absorbing functions hereof.

Figure 4:
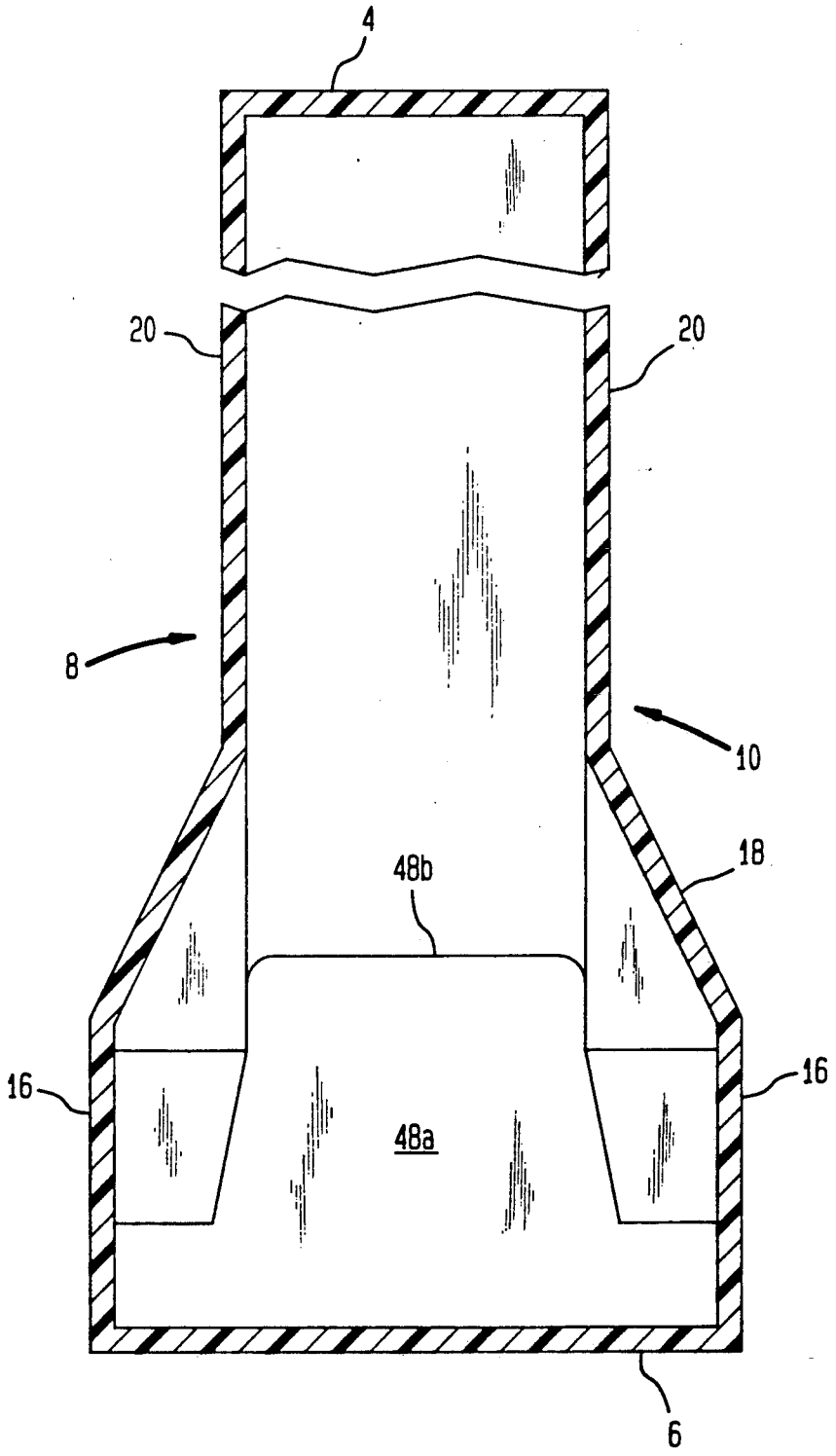
FIG. 4 is a sectional view of one of the highway barriers shown in FIG. 1, taken along line 4—4 thereof.
Figure 5:
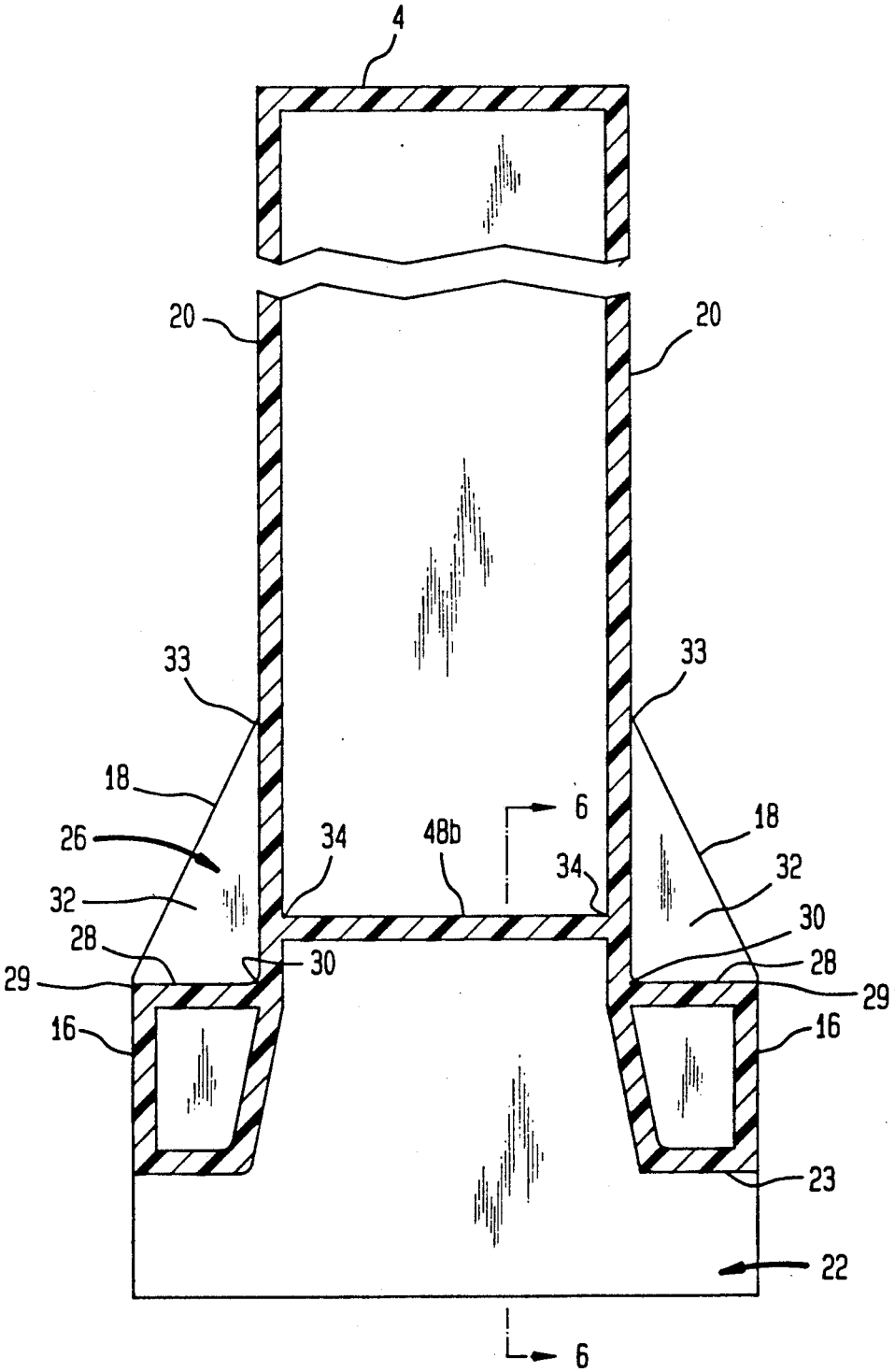
FIG. 5 is a sectional view of one of the highway barriers shown in FIG. 1, taken along line 5—5 thereof.

Particularly when used for the latter purposes the stability of each individual highway barrier becomes of extreme significance. In that regard, the highway barriers of the present invention are significantly improved and strengthened by the presence of indentations 26 therealong. More particularly, again referring to FIG. 1, these indentations are preferably located within the intermediate portions 18 of the barriers 2 hereof. A number of spaced indentations 26 are provided. Each of these indentations includes a base portion 28, which is substantially trapezoidal in configuration, since the two side walls are preferably not parallel, but instead converge inwardly from the front edge 29, which is preferably about 3 inches wide, to the back edge 30 thereof so that the back edge 30 is somewhat narrower than the front edge 29, i.e., less than about 3 inches. The overall depth of these indentations, from the front edge 29 to the back edge 30 will thus preferably be at least about 4 inches, and preferably between about 4 and 5 inches. The indentations 26 further include a pair of triangular side walls 32 extending upwardly to a vertex 33 at the point of intersection between intermediate portions 18 and upper portions 20 of the side walls 8 and 10, as well as a substantially rectangular inner end wall 34. As will be further appreciated below and as seen in FIGS. 4 and 5, the inner surface of the hollow highway barriers hereof thus include corresponding shaped inwardly extending wall portions defined by these indentations 26, thus creating baffles within the container so that upon filling with a fluid movement of the fluid within the container is dampened. Preferably, a number of evenly spaced indentations, such as the five indentations shown in the highway barrier of FIG. 1, are included therealong, preferably spaced apart by about 9½ inches.

The presence of these indentations 26 in side walls 8 and 10 in highway barriers 2 of the present invention is significant in providing each individual barrier 2 with the necessary stability and semi-rigid character so as to withstand major impacts in a far superior manner to that which would take place in their absence, as well as to provide enough structural stability so that either empty or when filled with water (as per the discussion set forth below), each of the individual barriers can be self-sustaining, or can "stand alone." Because of the presence of these indentations 26, upon impact the side walls 8 and 10 can more readily absorb and disburse the energy of that impact. This is apparently accomplished by sequential impact from indentation to indentation; i.e., upon each such impact the indentations themselves act as independent impact points, causing an accordian-type effect thereon, with sequential deformation taking place therein.

Figure 6:
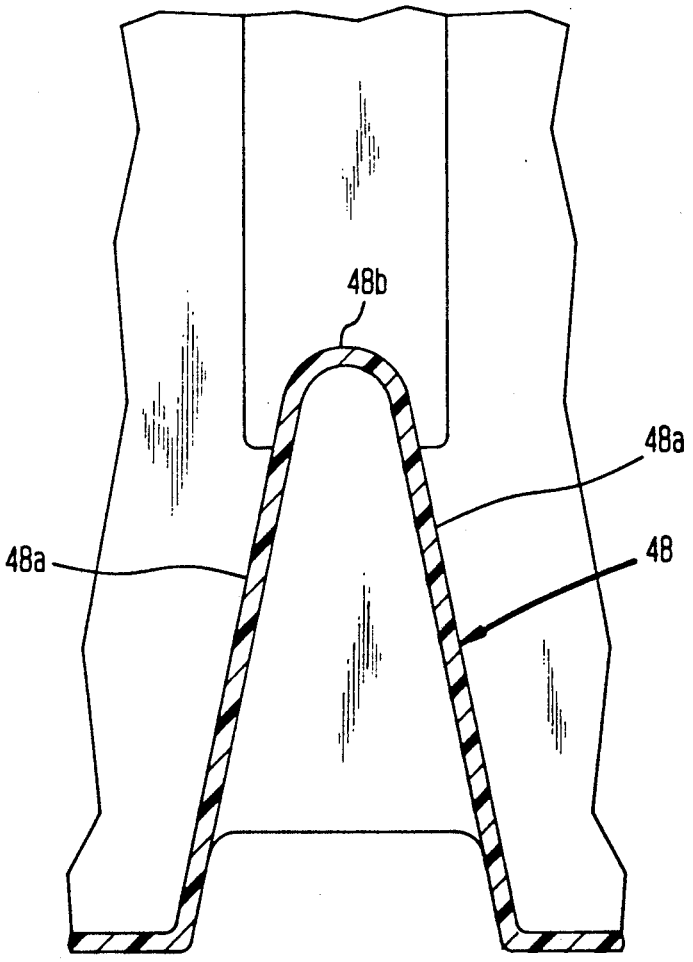
FIG. 6 is a partial, sectional view of a cross member of a highway barrier in accordance with the present invention taken along line 6—6 of FIG. 5 thereof.

Furthermore, in a preferred embodiment of the present invention as shown in the Figures, within the highway barriers 2 themselves and connecting the inner surface of the substantially rectangular inner end walls 34 of corresponding indentations 26 on either side of the highway barrier 2, are cross members 48. These cross members thus extend from the base 6 on either side of the passageways 22*a–c* corresponding to each such indentation 26 with which they are associated, upwardly to a point corresponding to the vertex 33, or to the point of transition between the intermediate portion 18 and the upper portion 20 of the side walls 8 and 10. In cross section the shape of this cross member 48 will be an inverted "U" as shown in FIG. 6, thus having a pair of upstanding side wall portions 48*a* and horizontal top portion 48*b*. This shape reflects itself in a corresponding U-shaped indentation within the upper wall portion 23 of the passageways 22*a–c*, with a width either corresponding to the width of each such passageway 22*a–c*, or corresponding to only a portion of these passageways where they are wide, as with passageway 22*a*. The presence of these internal cross members 48 further strengthens and rigidifies the overall highway barriers 2 hereof, thus permitting their individual use either empty or filled with water. Furthermore, when filled with water, the internal cross members 48 provide additional function in terms of dampening movement of the water within the barrier and providing further stability thereto.

Figure 2:
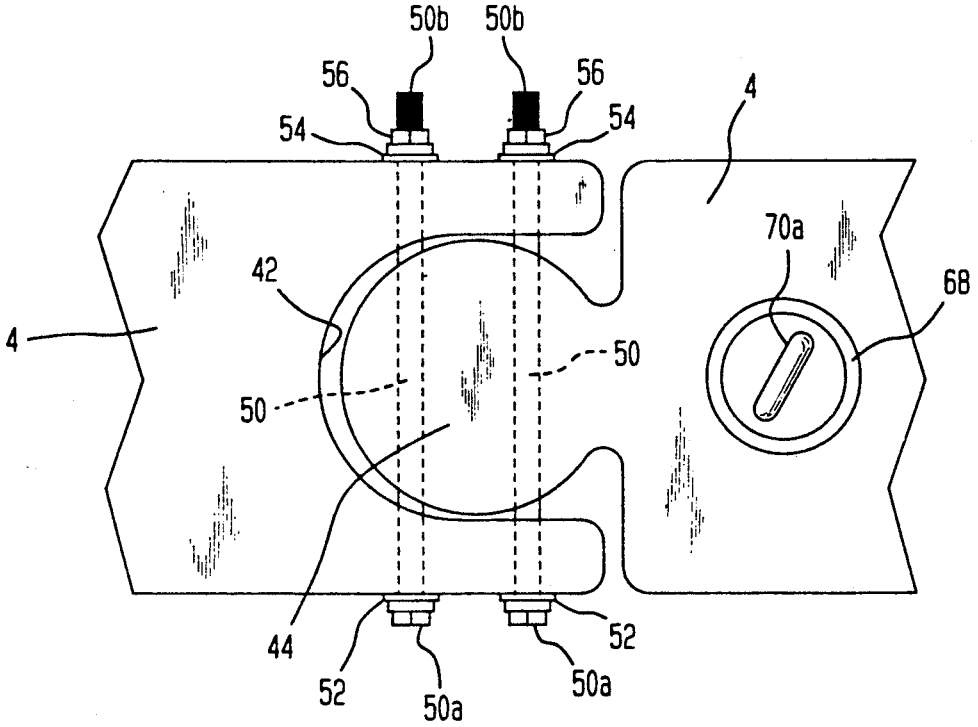
FIG. 2 is a top, elevational, partial view of a portion of the connection between a pair of highway barriers in accordance with the present invention.
Figure 3:
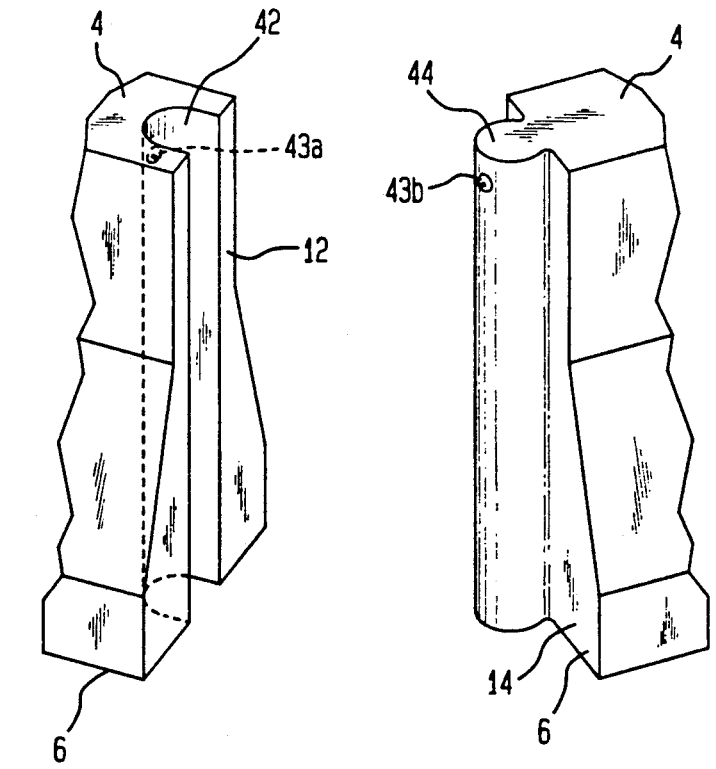
FIG 3 is an end, elevational, perspective view of the female end and the male end of a pair of highway barriers in accordance with the present invention.

The highway barriers of the present invention can also be used attached in an end-to-end manner both for providing a continuous highway barrier in the manner discussed above or to provide a small number of such barriers connected together for other such purposes. In order to accomplish this, each of the highway barriers 2 hereof includes a male end and a female end. In particular, and referring to FIG. 3 in this regard, end wall 12 includes a female portion comprising substantially semicircular-shaped cylindrical indentation 42 extending from the top 4 to the bottom 6 along end wall 12. On the other hand, end wall 14 includes an outwardly extending semicircular cylindrical extension portion 44 extending from the top wall 4 to the bottom wall 6 thereof. As can be seen, extension portion 44 of end wall 14 and indentation portion 42 of end wall 12 have corresponding shapes so that extension portion 44 can sit directly within indentation portion 42 for aligning and connecting to highway barriers 2 in the manner shown in the manner shown in FIG. 1. Because of the nature and configuration of these connecting members, this connection can be either an in-line connection as shown in FIG. 1, or the angle of connection can be varied from the 180° angle shown in FIG. 1 to a relative angle as between the two barriers, of up to about 5° by merely rotating one barrier with respect to the other while maintaining extension portion 44 in indentation portion 42. The two highway barriers can then be rigidly attached to each other at this desired angular relationship. Thus, angular relationships of greater than about 5° are possible without bolting or affixing the barriers together. Such affixing at an angle of up to about 5° can be accomplished in the manner shown in FIG. 2. In particular, after the extension portion 44 of one highway barrier 2 has been inserted into the indentation portion 42 of the corresponding adjacent highway barrier 2, and they are then rotated to obtain the desired alignment therebetween, they are attached rigidly in that alignment by first drilling one or two transverse bores through the corresponding male and female members in the manner shown in FIG. 2. In FIG. 2 a pair of bolts within those bores are shown. The drilling procedure is facilitated by the nature of these highway barriers and the hollow configuration thereof, again by merely drilling through the thin layers of plastic defining these containers. A pair of bolts 50 having head portions 50*a* are then passed through these bores after washers 52 are provided. Corresponding washers 54 are then provided on the other side of the bores, and nuts 56 can then be screwed onto the threaded ends 50*b* of the bolts 50 and tightened to rigidify the desired angular relationship and attach the two highway barriers together in that manner.

Figure 7:
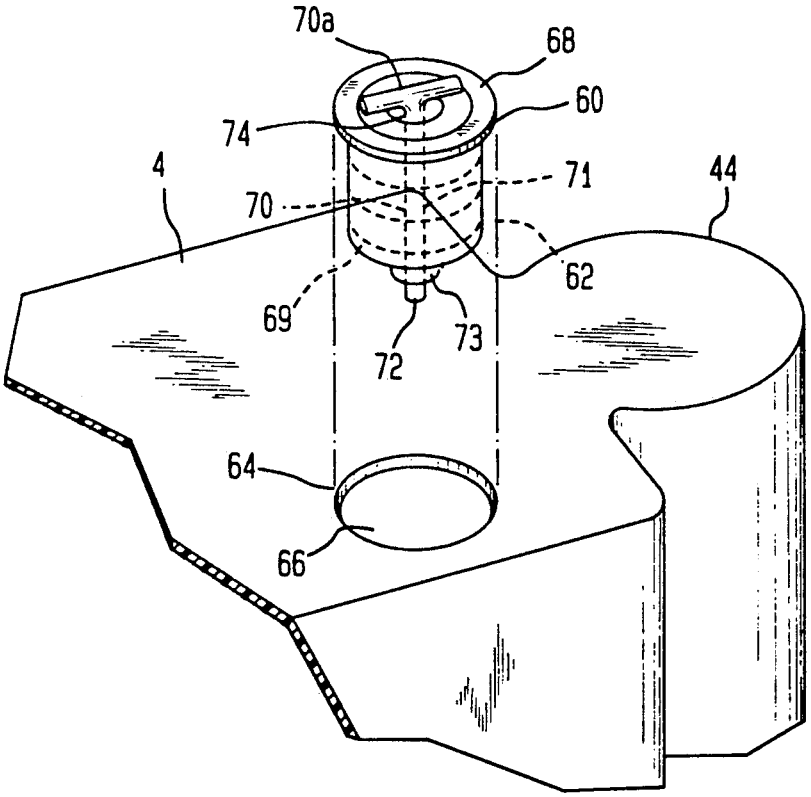
FIG. 7 is a top, elevational, perspective view of a portion one end of a highway barrier in accordance with the present invention.

A preferred means to provide for filling the highway barriers of this invention with water when desired is specifically shown in FIG. 7. Thus, at one or more locations in the top wall 4 of the highway barrier 2 there is provided an opening 60 into a well portion 62 having a cylindrical portion and a base portion 64 having an annular configuration providing a central opening 66 therein. In this manner, the highway barrier can be filled with water by merely supplying water to the well portion 62 to flow through the central bore 66 into the interior of the highway barrier 2 itself. In order to seal off this opening, either before actual filling with water, or to be used when no such filling is desired, a circular disk 68, preferably formed of metal and having a central bore, is provided. This disk 68 carries a rubber stopper 69 which is cylindrical and fits readily into the wall portion 62. The rubber stopper 69 includes a central passage 70 through which a bolt 71 can extend. Bolt 71 includes a winged end 74 which acts as a handle, and bolt 71 includes a threaded lower end 72. The bolt 71 extends through a central opening in the circular disk 68 as well as through the central passage 70 in rubber stopper 69, and a nut 73 can be affixed to its threaded end 72. Therefore, by turning winged end 74, the threaded end 72 tightens nut 73, thus squeezing the rubber stopper 69 therebetween. This, in turn, expands the side walls of the rubber stopper 69 against the walls of well portion 62, forming a seal thereby. In the configuration shown in FIG. each of the highway barriers 2 includes a pair of these wells 62 in the manner discussed herein. Subsequent to the filling procedure, the rubber stopper 69 can either be replaced and tightened, in order to seal the container, or it can be left off, with the water being retained within the container and opening 66 providing for pressure release therefrom.

More particularly, it is possible in accordance with this invention, to provide for different water levels and for different methods of sealing these highway barriers. Each of these modified uses can allow for differences in the reactions of these barriers upon impact. If, for example, the filling holes are not plugged, but are left open, the barrier will disperse less energy upon impact, but it will do so more rapidly. On the other hand, if the barrier is resealed after filling, it will allow for compression of the air therewithin, the amount of which will also vary depending upon the water level selected within that barrier. This, too, will permit alteration of the rate of energy absorption thereby.

It is also possible to fill a number of the containers hereof affixed together in the manner shown in FIG. 1 through a single one of the containers. This can be accomplished in a manner similar to that shown in U.S. Pat. No. 4,946,306, by providing corresponding openings at the upper ends of the male and female portions 44 and 42, respectively, as indicated by circular passages 43*b* and 43*a* shown in FIG. 3, and then providing a temporary tubular fitting therebetween so as to direct a flow of water therethrough when the water level in one of the barriers reaches the level of that opening. The water can then flow through the two openings, via the intermediate connector, so as to fill the second barrier from the first barrier, and so on if desired.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A highway barrier comprising a longitudinally extending container having a base portion, a pair of side walls, a pair of end walls, and a top portion, said container being substantially hollow and comprising a semi-rigid plastic material whereby said container is self-supporting and has a predetermined shape, said pair of side walls including a plurality of vertically extending indentations, said indentations including an inwardly directed base portion and a pair of side walls, whereby structural integrity of said container is maintained and said pair of side walls creates baffles within said container so that upon filling said container with a fluid the structural integrity of said container continues to be maintained and the movement of said fluid within said container is dampened.

2. The highway barrier of claim 1 wherein said plurality of vertically extending indentations includes an inner wall surface.

3. The highway barrier of claim 2 wherein said inner wall surface of said plurality of vertically extending indentations has a rectangular shape.

4. The highway barrier of claim 2 including a plurality of cross members within said container extending between said inner wall surface of said plurality of vertically extending indentations.

5. The highway barrier of claim 4 wherein said plurality of cross members has a height substantially corresponding to the height of said plurality of vertically extending indentations.

6. The highway barrier of claim 1 wherein said base portion of said plurality of vertically extending indentations has a trapezoidal shape.

7. The highway barrier of claim 1 wherein said pair of side walls of said plurality of longitudinally extending indentations have triangular shapes.

8. The highway barrier of claim 1 wherein said pair of end walls comprises a first end wall and a second wall, said first end wall including a protruding male portion and said second end wall including an inwardly directed female portion, whereby a plurality of said highway barriers may be attached in an end-to-end relationship to provide a continuous highway barrier structure.

9. The highway barrier of claim 8 wherein said protruding male portion of said first end wall and said inwardly directed female portion of said second end wall extend vertically from said base portion of said container to said top portion of said container.

10. The highway barrier of claim 9, wherein said protruding male portion of said first end wall and said inwardly directed female portion of said second end wall are substantially cylindrical in configuration.

11. The highway barrier of claim 1 including filling means for filling said substantially hollow container with a fluid whereby said filling of said container with said fluid substantially increases the weight of said container without changing said predetermined shape thereof.

12. The highway barrier of claim 1 wherein said pair of side walls includes a lower portion extending substantially vertically from said base portion for a first predetermined distance, an intermediate portion projecting inwardly from said lower portion a second predetermined distance at a predetermined angle with respect to the vertical, and an upper portion extending substantially vertically from said intermediate portion a third predetermined distance to said top portion of said longitudinally extending container.

13. The highway barrier of claim 12 wherein said plurality of vertically extending indentations are substantially contained within said intermediate portion of said pair of side walls.

14. The highway barrier of claim 1 including transverse groove means extending across said base portion so as to permit fluid to flow under said base portion of said longitudinally extending container.

15. The highway barrier of claim 12 including a plurality of said transverse groove means.

16. The highway barrier of claim 15 wherein said plurality of said transverse groove means includes a first pair of transverse groove means having a first width and a second pair of transverse groove means having a second width, whereby said first and second pairs of said transverse groove means are adapted to accommodate forklift apparatus of different sizes.

17. The highway barrier of claim 1 wherein said semi-rigid plastic is selected from the group consisting of low density polyethylene, acrylonitrile butadiene styrene, high impact styrene, and polycarbonate.

18. The highway barrier of claim 1 wherein said semi-rigid plastic material has a thickness of between about one-eighth and one inch.

19. The highway barrier of claim 1 wherein said base portion of said plurality of vertically extending indentations has a depth of at least about 4 inches.

20. A highway barrier comprising a longitudinally extending container having a base portion, a pair of side walls, a pair of end walls, and a top portion, said container being substantially hollow and comprising a semi-rigid plastic material whereby said container is self-supporting and has a predetermined shape, said pair of end walls including a first end wall and a second end wall, said first end wall including a substantially cylindrical protruding male portion and said second end wall including a correspondingly substantially cylindrical inwardly directed female portion adapted to accept said male portion, whereby a plurality of said highway barriers can be attached in an end-to-end relationship and the longitudinal alignment of said plurality of highway barriers may be altered to a predetermined longitudinal alignment by rotating said male portion within said female portion, and connecting means comprising bolt means extending transversely through said male and female portions of said attached plurality of highway barriers and nut means for fixing said bolt means therein, for fixedly connecting said plurality of highway barriers together in said predetermined longitudinal alignment.

21. The highway barrier of claim 20 wherein said bolt means comprises a pair of bolt members.

22. The highway barrier of claim 20 wherein said pair of side walls includes a plurality of vertically extending indentations, said indentations including an inwardly directed base portion and a pair of side walls, whereby structural integrity of said container is maintained and said pair of side walls creates baffles within said container so that upon filling said container with a fluid the structural integrity of said container continues to be maintained and the movement of said fluid in said container in dampened.

23. The highway barrier of claim 22 wherein said plurality of vertically extending indentations includes an inner wall surface.

24. The highway barrier of claim 23 wherein said inner wall surface of said plurality of vertically extending indentations has a rectangular shape.

25. The highway barrier of claim 23 including a plurality of cross members within said container extending between said inner wall surfaces of said plurality of vertically extending indentations.

26. The highway barrier of claim 25 wherein said plurality of cross members has a height substantially corresponding to the height of said plurality of vertically extending indentations.

27. The highway barrier of claim 22 wherein said base portion of said plurality of vertically extending indentations has a trapezoidal shape.

28. The highway barrier of claim 22 wherein said pair of side walls of said plurality of longitudinally extending indentations has triangular shape.

29. The highway barrier of claim 20 including filler means for filling said substantially hollow container with a fluid whereby said filling of said weight of said container without changing the predetermined shape thereof.

30. The highway barrier of claim 20 wherein said pair of side walls includes a lower portion extending substantially vertically from said base portion for a first predetermined distance, an intermediate portion projecting inwardly from said lower portion a second predetermined distance at a predetermined angle with respect to the vertical, and an upper portion extending substantially vertically from said intermediate portion a third predetermined distance to said top portion of said longitudinally extending container.

31. A highway barrier comprising a longitudinally extending container having a base portion, a pair of side walls, a pair of end walls, and a top portion, said container being substantially hollow and comprising a semi-rigid plastic material whereby said container is self-supporting and has a predetermined shape, said pair of side walls including a plurality of vertically extending indentations, said indentations including an inwardly directed base portion and a pair of side walls, whereby structural integrity of said container is maintained and said pair of side walls creates baffles within said container so that upon filling said container with a fluid the structural integrity of said container continues to be maintained and the movement of said fluid in said container is dampened, said pair of end walls including a first end wall and a second end wall, said first end wall including a substantially cylindrical protruding male portion and said second end wall including a correspondingly substantially cylindrical inwardly directed female portion adapted to accept said male portion, whereby a plurality of said highway barriers can be attached in an end-to-end relationship and the longitudinal alignment of said plurality of highway barriers may be altered to a predetermined longitudinal alignment by rotating said male portion within said female portion.

32. The highway barrier of claim 31 wherein said plurality of vertically extending indentations includes an inner wall surface.

33. The highway barrier of claim 32 wherein said inner wall surface of said plurality of vertically extending indentations has a rectangular shape.

34. The highway barrier of claim 32 including a plurality of cross members within said container extending between said inner wall surfaces of said plurality of vertically extending indentations.

35. The highway barrier of claim 34 wherein said plurality of cross members has a height substantially corresponding to the height of said plurality of vertically extending indentations.

36. The highway barrier of claim 31 wherein said base portion of said plurality of vertically extending indentations has a trapezoidal shape.

37. The highway barrier of claim 31 wherein said pair of side walls of said plurality of longitudinally extending indentations has a triangular shape.

38. A highway barrier comprising a longitudinally extending container having a base portion, a pair of side walls, a pair of end walls, and a top portion, said container being substantially hollow and comprising a semi-rigid plastic material whereby said container is self-supporting and has a predetermined shape, said pair of end walls including a first end wall and a second end wall, said first end wall including a substantially cylindrical protruding male portion and said second end wall including a correspondingly substantially cylindrical inwardly directed female portion adapted to accept said male portion, said substantially cylindrical protruding male portion having a height as measured from said first end wall which is greater than the depth of said correspondingly substantially cylindrical inwardly directed female portion of said second end wall, whereby when said female portion has accepted said male portion sufficient space remains between said first and second end walls such that said male portion may be rotated within said female portion so as to alter the end-to-end relationship therebetween.

39. The highway barrier of claim 38 including connecting means for fixedly connecting said plurality of highway barriers together in said predetermined longitudinal alignment.

40. The highway barrier of claim 39 wherein said connecting means comprises bolt means extending transversely through said male and female portions of said attached plurality of highway barriers and nut means for fixing said bolt means therein.

41. The highway barrier of claim 40 wherein said bolt means comprises a pair of bolt members.

42. The highway barrier of claim 38 wherein said pair of side walls includes a plurality of vertically extending indentations, said indentations including an inwardly directed base portion and a pair of side walls, thereby structural integrity of said container is maintained and said pair of side walls creates baffles within said container so that upon filling said container with a fluid the structural integrity of said container continues to be maintained and the movement of said fluid in said container in dampened.

43. The highway barrier of claim 42 wherein said plurality of vertically extending indentations includes an inner wall surface.

44. The highway barrier of claim 43 wherein said inner wall surface of said plurality of vertically extending indentations has a rectangular shape.

45. The highway barrier of claim 43 including a plurality of cross members within said container extending between said inner wall surfaces of said plurality of vertically extending indentations.

46. The highway barrier of claim 45 wherein said plurality of cross members has a height substantially corresponding to the height of said plurality of vertically extending indentations.

47. The highway barrier of claim 42 wherein said base portion of said plurality of vertically extending indentations has a trapezoidal shape.

48. The highway barrier of claim 42 wherein said pair of side walls of said plurality of longitudinally extending indentations has triangular shape.

49. The highway barrier of claim 38 including filler means for filling said substantially hollow container with a fluid whereby said filling of said container with said fluid substantially increase the weight of said container without changing the predetermined shape thereof.

50. The highway barrier of claim 38 wherein said pair of said walls includes a lower portion extending substantially vertically from said base portion for a first predetermined distance, an intermediate portion projecting inwardly from said lower portion a second predetermined distance at a predetermined angle with respect to the vertical, and an upper portion extending substantially vertically from said intermediate portion a third predetermined distance to said top portion of said longitudinally extending container.

* * * * *

UNITED STATES PATENT AND TRADEMARK OFFICE

CERTIFICATE OF CORRECTION

PATENT NO. : 5,123,773

DATED : June 23, 1992

INVENTOR(S) : Leo J. Yodock

It is certified that error appears in the above-identified patent and that said Letters Patent is hereby corrected as shown below:

Column 1, line 45, after "in" insert --Fitch, U.S. Patent No. 3,606,258, which is designed to--.
Column 4, line 7, after "portion" insert --of--.
Column 10, line 5, delete "12" and insert therefor --14--.
Column 11, line 13, after "said" (second occurrence) insert --container with said fluid substantially increases the--.
Column 12, line 39, delete "thereby" and insert therefor --whereby--.
Column 13, line 1, "increase" should read --increases--.

Signed and Sealed this

Seventeenth Day of August, 1993

Bruce Lehman

*Attest:*

BRUCE LEHMAN

*Attesting Officer*

*Commissioner of Patents and Trademarks*